United States Patent [19]

Heims et al.

[11] Patent Number: 4,507,014

[45] Date of Patent: Mar. 26, 1985

[54] CONSOLIDATING PLANK FOR A HIGHWAY FINISHING MACHINE

[75] Inventors: Dirk Heims, Bad Munder; Hans-Gert Ottermann; Robert Prang, both of Hameln, all of Fed. Rep. of Germany

[73] Assignee: ABG-Werke GmbH, Hameln, Fed. Rep. of Germany

[21] Appl. No.: 493,416

[22] Filed: May 10, 1983

[30] Foreign Application Priority Data

Jan. 4, 1983 [DE] Fed. Rep. of Germany ..... 3300092

[51] Int. Cl.[3] ..... E01C 19/30

[52] U.S. Cl. ..... 404/102; 404/113; 404/133; 173/101

[58] Field of Search ..... 404/133, 102, 96, 105, 404/106, 113, 104; 299/37; 173/101; 74/586

[56] References Cited

U.S. PATENT DOCUMENTS

| | | | |
|---|---|---|---|
| 1,306,353 | 6/1919 | Reynolds | 404/102 |
| 1,898,158 | 2/1933 | Winkler | 404/102 |
| 2,098,895 | 11/1937 | Velten | 404/133 |
| 2,495,084 | 1/1950 | Wells | 74/586 |
| 2,902,908 | 9/1959 | Schiavi | 404/133 |
| 2,908,206 | 10/1959 | Melanson | 404/133 |
| 3,377,933 | 4/1968 | Dale | 404/133 X |
| 3,899,262 | 8/1975 | Yamamoto | 404/133 |
| 3,961,856 | 6/1976 | Degenhart | 404/133 |
| 4,127,351 | 11/1978 | Vural | 404/133 X |
| 4,272,213 | 6/1981 | McGovarin | 404/104 X |

FOREIGN PATENT DOCUMENTS

| | | | |
|---|---|---|---|
| 2100324 | 12/1982 | United Kingdom | 404/102 |

*Primary Examiner*—Stephen J. Novosad
*Assistant Examiner*—Beverly E. Hjorth
*Attorney, Agent, or Firm*—McCormick, Paulding & Huber

[57] ABSTRACT

The invention concerns a consolidating plank for a highway finishing machine the basic plank body of which is lengthenable by a manually attachable plank or by an extendible plank. For creating such a high compacting effect that a subsequent following compaction is saved, a stamp unit having at least two stamps is provided, which stamps have a common eccentric support.

3 Claims, 1 Drawing Figure

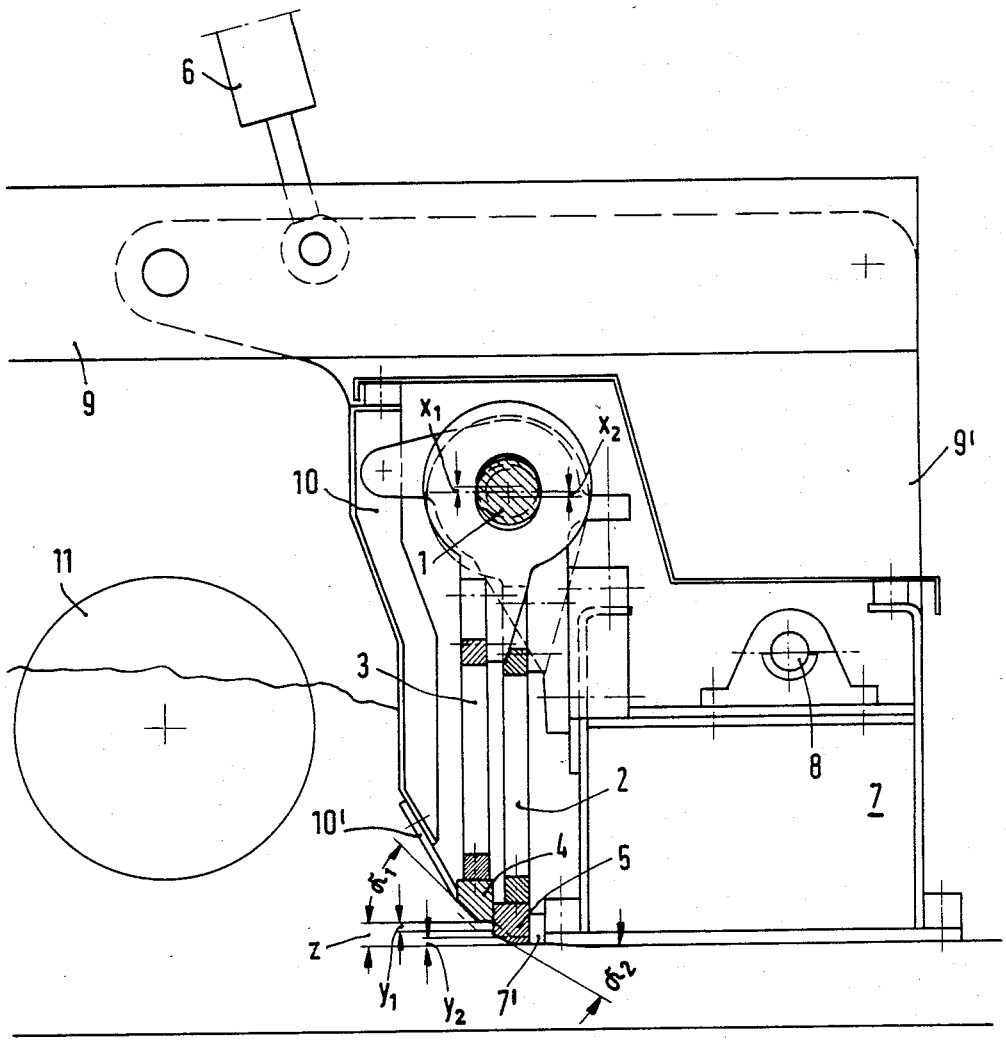
6
9
9'
10
11
1
3
2
8
7
10'
4
5
z
7'

CONSOLIDATING PLANK FOR A HIGHWAY FINISHING MACHINE

The invention relates to a consolidating plank for a highway finishing machine according to the preamble of claim 1.

The object of the invention is to provide a consolidating plank according to the preamble of FIG. 1 which through its high compacting ability avoids the need for a subsequent following compaction of the material.

This object is solved in accordance with the characterizing portion of claim 1.

By means of the provided stamping unit the need for a subsequent following compaction of the construction material is spared and it is possible to make highways or the like with generally smaller machine and personnel requirements than in the past. The stamping unit is especially useful with planks which may be manually added to as well as with extensible planks.

Further refinements of the invention may be understood from the dependent claims and the following description.

The invention is hereafter explained in more detail in connection with the exemplary embodiment shown by the accompanying drawing which shows a plank in side view partially in section.

In the drawing only the ends of two support arms 9 of a highway finishing machine are shown which support arms lie behind one another as seen in the plane of the drawing and which may be pivotally connected to the highway finishing machine for adjustment in heighth and which carry a consolidating plank. The consolidating plank comprises two support plates 9' pivotally connected to the support arms 9 with which support plates a plank body 7 is connected, which plank body if necessary is provided with a vibrating device 8. Further a distributing screw 11 is provided for distributing the construction material over the construction width in connection with which the consolidating plank has a forward wall 10 located behind the distributing screw 11 with a guide plate 10' arranged on the lower edge of the forward wall 10 so as to incline rearwardly.

Behind the forward wall 10 are located two stamps 2, 3 with corresponding stamp bars 4, 5 which compact the construction material distributed by the distributing screw 11. The forward stamp 3, which is limited by the angle $\alpha_1$ the forward edge of its stamp bar 4 makes with the horizontal, divides the construction material into doses and preconsolidates it, while the rear stamp 2, limited by the angle $\alpha_2$ which the forward edge of its stamp bar 5 makes with the horizontal, effects the final compaction.

The guide plate 10' ends with its lower edge in the area of the inclined forward edge of the stamp bar 4 and guides the construction material to the stamp bars 4, 5. The stamp bars 4, 5 are arranged so as to be directly adjacent to one another and slide relative to one another during the eccentric drive of the stamps 2, 3. On its rear side the stamp bar 5 slides relative to an adjacent sealing strip 7' fixed to the plank body 7. Also, more than two stamps 2, 3 with corresponding stamp bars 4, 5 can be provided and the angle of inclination of their forward edges can be different from one another or they can also be of the same size.

The stamps 2, 3 are supported in common on an eccentric shaft 1 wherein the eccentricity $x_1$ which effects the stroke for the forward stamp 3 is preferably set to be 180° from the eccentricity $x_2$ for the rear stamp 2. By means of these displaced eccentric supports for the stamps 2, 3 the stamps run oppositely to one another, whereby along with an increased specific surface pressure under the stamp bars 4 and 5 an advantageous mass balance for the smooth running of the consolidating plank is achieved which moreover is beneficial to the preference of the drive.

Advantageously the strokes $y_1$ and $y_2$ of the stamps 3, 2 can be adjustable corresponding to the construction material and to the desired surface strength of the consolidated material, and indeed preferably are reducible to zero. Also adjustment of the vertical distance z by which the forward stamp bar 4 is vertically displaced above the rear stamp bar 5 and above the undesurface of the plank can also be provided. Preferably the speed of rotation of the stamping unit can also be infinitely adjustable. For adjustment of the stamping unit as well as for an eventual required compensating for wear it is advantageous that a height adjustment of the stamping unit relative to the supporting plank body 7 be provided.

For increasing the compaction of the construction material the consolidating plank can be additionally hydraulically loaded by means of at least one double-acting hydraulic cylinder 6 which projects from the nonillustrated rear wall of the highway finishing machine. The hydraulic plank loading is adjustable and so hydraulically formed that the principle of the "swimming plank" is obtained. The hydraulic plank load is effective only during the consolidation, and while the highway finishing machine is standing still it is lifted by means of an electrohydraulic interlock with the drive unit for propelling the machine forwardly. By means of this hydraulic plank loading it is not required generally to substantially increase the plank weight for any special circumstances.

The stamping unit is usable with a basic plank body as well as with one which is divided to allow adjustment of the surface profile in which case the basic plank body can be widened by means of screw-on plank lengthening units (a manually added to plank) as well as by at least one supplemental plank located behind the base plank in the drive direction which supplemental plank is slidingly adjustable in the direction perpendicular to the drive direction (an extendible plank).

We claim:

1. A consolidating plank mechanism for a road finishing machine movable in a driving direction during operation, said plank including a basic plank body having a downwardly facing undersurface extending perpendicular to said driving directiion, a stamping unit in front of said plank body with respect to said driving direction of said machine, said stamping unit having at least two cooperating stamps slidably engageable with one another and extending perpendicular to said driving direction along the length of said plank body, said two stamps consisting of a rear stamp located immediately in front of said plank body and a forward stamp located immediately in front of said rear stamp, each of said two stamps having a lower end portion with a generally downwardly directed stamping face, means providing a forwardly directed vertical guide face on the forward side of said plank body, said rear stamp having a lower end portion with a rear vertical face slidably engaging said guide face of said plank body so that no substantial space exists between said rear stamp and said plank body in said driving direction of said machine, means located in front of said forward stamp for distributing loose construction material along the length and in advance of said forward stamp, a single eccentric drive shaft extending perpendicular to said driving direction and located above said stamping faces, and means drivingly connecting each of said stamps to said single eccentric drive shaft so that said stamps are vertically reciprocated out of phase with one another in response to rotation of said drive shaft, the vertical lengths of each of said two stamps between its downwardly directed stamping face and said eccentric drive shaft being such that said downwardly directed stamping face of said rear stamp is reciprocated at a level about equal to that of said undersurface of said plank body and said downwardly directed stamping face of said forward stamp is reciprocated at a slightly higher level than that of said rear stamp so that in the operation of said finishing machine as it moves forwardly in said driving direction said forward stamp first precompacts said construction material immediately following which said construction material is further compacted by said rear stamp and is then immediately run over by said undersurface of said plank body.

2. A consolidating plank mechanism according to claim 1 further characterized in that the vertical reciprocation of one of said stamps is 180° out of phase with the vertical reciprocation of the other of said stamps.

3. A consolidating plank mechanism as defined in claim 1 further characterized by means providing a forward generally vertical wall located immediately forwardly of said forward stamp, said forward wall extending perpendicular to said driving direction along the length of said forward stamp, said forward wall having a lower portion with a lower end edge located near said downwardly directed stamping face of said forward stamp and which lower portion is inclined so as to extend generally upwardly and forwardly from said lower edge, each of said two stamps having forward and rear vertical faces on their lower end portions, said rear stamp at its lower end being guided for vertical reciprocation by said sliding engagement of its rear vertical face with said guide face on said forward side of said plank body and by sliding engagement of its forward vertical face with said rear vertical face of said forward stamp, and said forward stamp at its lower end being guided for vertical reciprocation by said sliding engagement of its rear vertical face with said forward vertical face of said rear stamp and by sliding engagement of its forward vertical face with said lower edge of said lower forward wall portion.

* * * * *